United States Patent [19]

Yokomatsu

[11] Patent Number: 4,604,757

[45] Date of Patent: Aug. 5, 1986

[54] PAPER SACK WITH A VALVE FOR PACKAGING PULVERIZED OR GRANULAR MATERIALS

[76] Inventor: Masayoshi Yokomatsu, 25-11-25, Fukawa, Tone-machi, Kita-Soma-Gun, Ibaragi Prefecture, Japan

[21] Appl. No.: 626,596

[22] Filed: Jul. 5, 1984

Related U.S. Application Data

[63] Continuation of Ser. No. 415,183, Sep. 7, 1982, abandoned.

[30] Foreign Application Priority Data

| | | | |
|---|---|---|---|
| Sep. 7, 1981 | [JP] | Japan | 56-140721 |
| Nov. 20, 1981 | [JP] | Japan | 56-187506 |
| Dec. 3, 1981 | [JP] | Japan | 56-194741 |

[51] Int. Cl.[4] ..... B65D 30/24

[52] U.S. Cl. ..... 383/46; 383/53

[58] Field of Search ..... 383/44, 46, 54, 56, 383/45, 48, 51, 53; 138/172

[56] References Cited

U.S. PATENT DOCUMENTS

| | | | |
|---|---|---|---|
| 1,107,879 | 8/1914 | Bates | 383/44 |
| 1,492,960 | 5/1924 | Chambers | 383/56 X |
| 1,958,597 | 5/1934 | Sweeney . | |
| 2,040,335 | 5/1936 | Rosmait | 383/33 |
| 2,674,857 | 4/1954 | Fortes | 138/172 |
| 2,682,902 | 7/1954 | Metzger | 383/57 |
| 3,065,899 | 11/1962 | Means et al. | 383/54 |
| 3,102,676 | 9/1963 | Danelli et al. | 383/44 |
| 3,367,485 | 2/1968 | Schneider et al. | 383/44 X |
| 3,441,199 | 4/1969 | Brockmuller | 229/62.5 |
| 3,472,130 | 10/1969 | Brockmuller | 229/62.5 |
| 3,549,298 | 12/1970 | Brockmuller | 229/62.5 |
| 3,904,107 | 9/1975 | Nishimura | 229/62.5 |
| 3,990,626 | 10/1972 | Goodrich | 229/55 |
| 3,990,628 | 11/1976 | Van den Beld et al. | 229/62.5 |
| 4,091,986 | 5/1978 | Eberle | 229/62.5 |
| 4,095,736 | 6/1978 | Rothschild, III et al. | 229/62.5 |
| 4,132,347 | 1/1979 | Saito | 229/62.5 |
| 4,344,558 | 8/1982 | Newton et al. | 229/62.5 |
| 4,361,268 | 11/1982 | Sexton et al. | 229/62.5 |
| 4,364,510 | 12/1982 | Buchanan | 229/62.5 |
| 4,382,538 | 5/1983 | Wilherm | 229/62.5 |

FOREIGN PATENT DOCUMENTS

| | | | |
|---|---|---|---|
| 34606 | 4/1973 | Australia | 383/48 |
| 0075181 | 3/1983 | European Pat. Off. | 383/44 |
| 1295807 | 6/1966 | Fed. Rep. of Germany . | |
| 1301985 | 4/1967 | Fed. Rep. of Germany . | |
| 1586771 | 6/1967 | Fed. Rep. of Germany . | |
| 3203187 | 8/1983 | Fed. Rep. of Germany | 383/44 |
| 1389648 | 1/1965 | France | 383/45 |
| 338137 | 6/1959 | Switzerland | 383/44 |
| 656007 | 7/1951 | United Kingdom . | |

*Primary Examiner*—William Price
*Assistant Examiner*—Bryon Gehman
*Attorney, Agent, or Firm*—Parkhurst & Oliff

[57] ABSTRACT

A valve sack having a collapsible filling valve. A flattened tubular blank is formed by folding a second flap over a first flap to form a longitudinal seam. A valve is placed between the flaps transverse to the seam to provide communication with the interior of the sack, and is preferably located near one end of the sack. The valve may be formed in a variety of configurations, including a reinforcing projecting strip.

5 Claims, 29 Drawing Figures

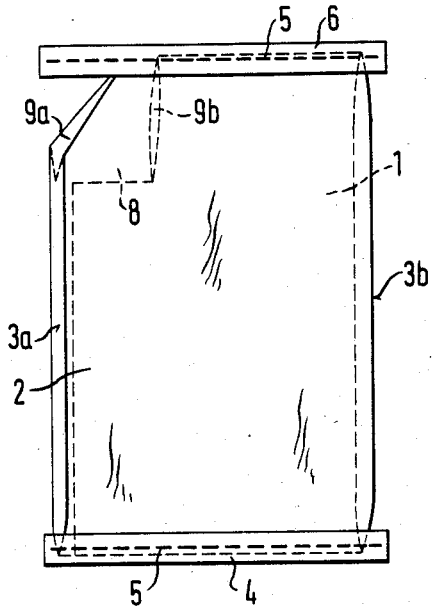
FIG. 1
FIG. 2
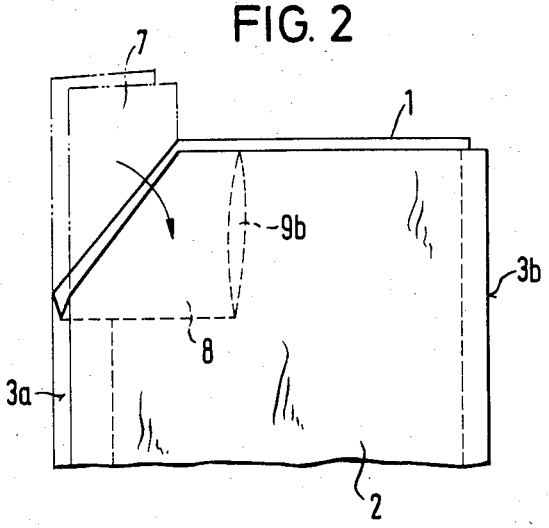
FIG. 3
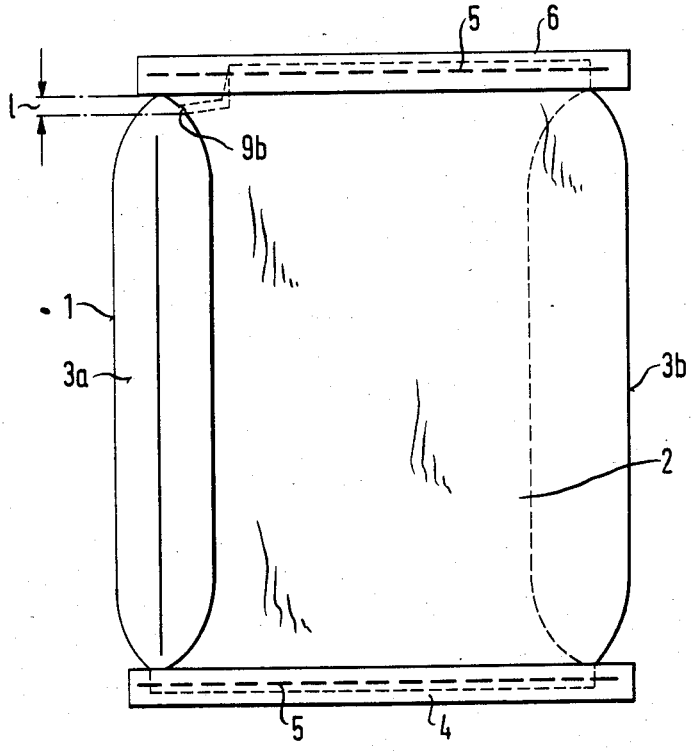

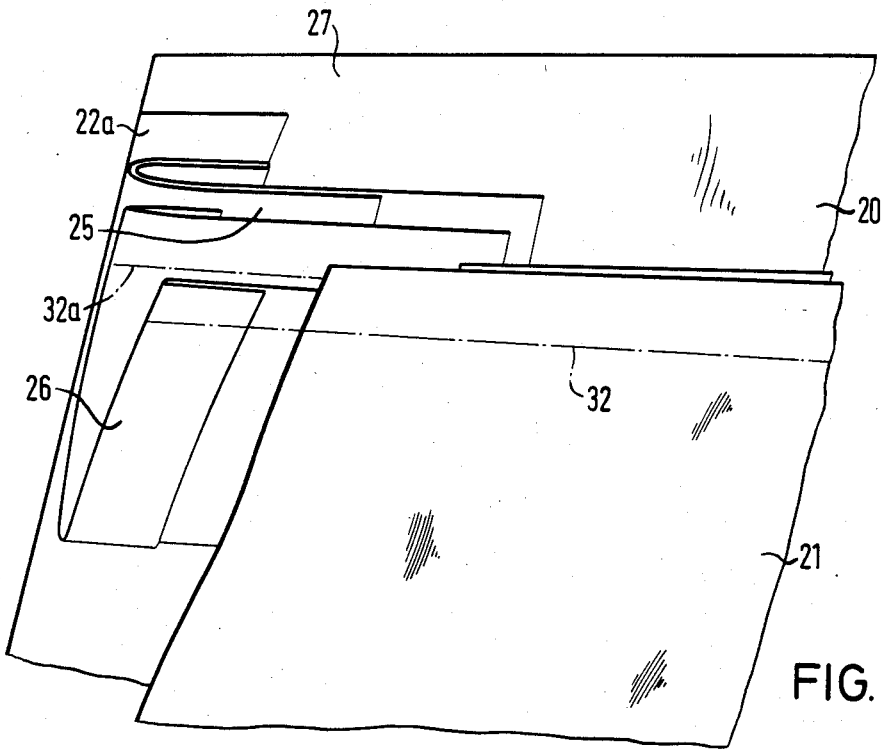
FIG. 10
FIG. 11
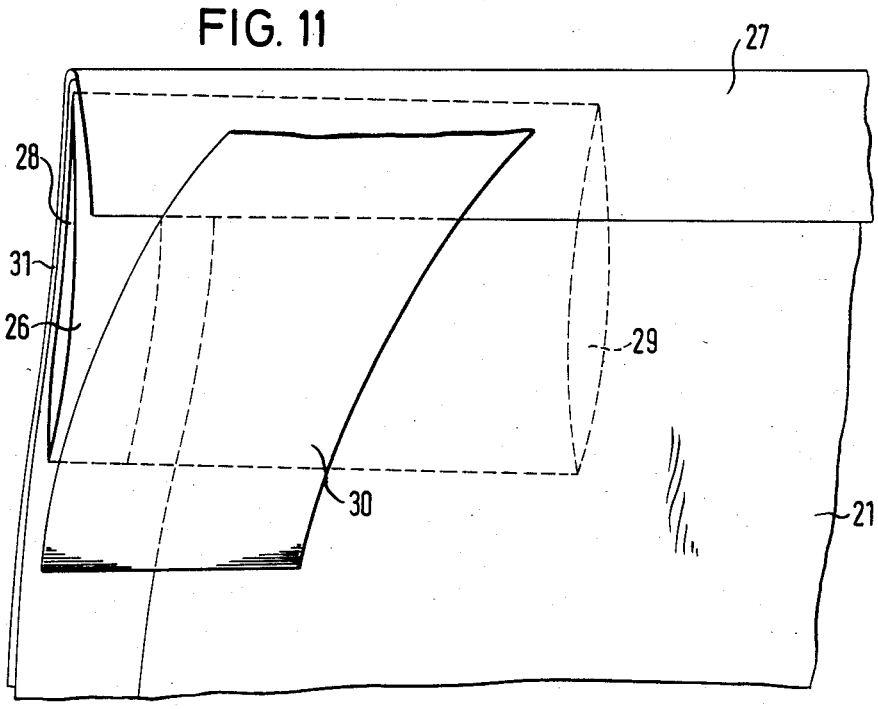

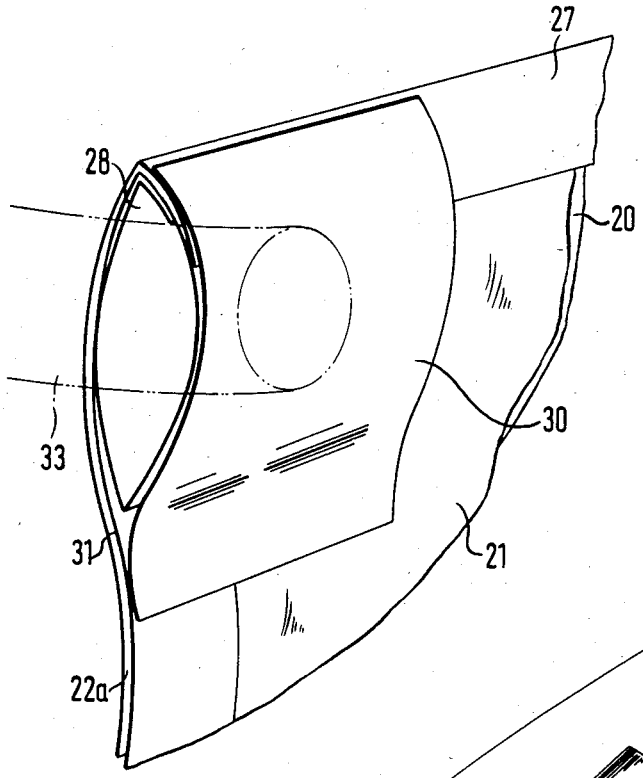
FIG. 12
FIG. 13
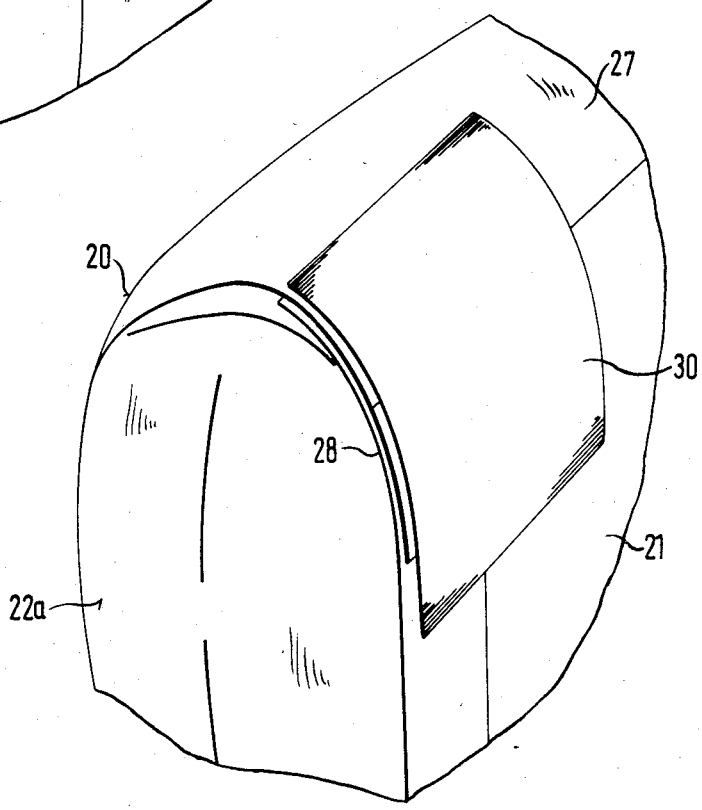

PAPER SACK WITH A VALVE FOR PACKAGING PULVERIZED OR GRANULAR MATERIALS

This is a continuation of application Ser. No. 415,183, filed Sept. 7, 1982, now abandoned.

BACKGROUND OF THE INVENTION

1. Field of the Invention

The invention relates to a single-layer or multi-layer paper sack, box-shaped when filled, which is closed at each of its two extremities by a simple singly or doubly folded wrapped end.

2. Description of the Prior Art

Prefabricated sacks, i.e. sacks already closed at both extremities and provided with a self-closing valve for filling, are generally designated valve sacks.

Such sacks have found wide application for packaging pulverous or granular materials, because in this way even sensitive material can be filled into self-closing prefabricated sacks without the need for a further closing operation after the filling operation.

Prior valve sacks are illustrated in FIGS. 1 to 6.

FIGS. 1 to 3 show a valve sack in which each of the two open flat-lying ends of the tube blank is covered by folded paper strips 4, 6 and sewn to the ends by the thread seam 5. FIG. 1 shows specifically the front elevation of this sewn valve sack, in which the back side of the sack is shown at 1 and the front side of the sack at 2. The sides are folded in the unfilled sack at 3*a* and 3*b*. FIG. 2 shows specifically the folded strip projecting in the open tube blank before the completion of the sack, which is tucked in before the application of the folded strip 6, as indicated by an arrow in FIG. 2. This produces the valve 8 (FIG. 1) with the interior filling orifice 9*b* after the sack is sewn. FIG. 3 shows this sewn sack in the filled state, in which the lateral folds 3*a*, 3*b*, which still lie virtually flat in FIG. 1, have now been opened by the contents to form the narrow side of the sack, which is virtually box-shaped in the filled state. Since the valve 7, 8 is folded in directly from the paper tube, a slight shortening 1 (FIG. 3) in the region of the valve occurs in the filled sack. Here, the closure strip 6 hangs freely and the sack extremity is not positively sewn, but is nevertheless closed by the tucked-in valve tube.

The sewn valve sack illustrated in FIGS. 1–3 has the advantage of extremely simply shaped sack extremities on both side. However, it has the disadvantage that high stresses occur in the filled state due to the large number of holes in the two thread seams 5, and also the sack is not powder-tight.

In contrast to the above, a sack of more complicated shape is illustrated in FIGS. 4–6. This sack is distinguished from the sewn valve sack by a cross end shaped at the two extremities of the initially open paper tube. A valve tube, wound from a paper sheet and glued is also let into the one of the two cross ends, and forms the filling valve for this valve sack. FIG. 6 shows specifically the still open valve sheet, which has been prefolded in the two lines 11*a*, 11*b* and the line 12 before it is folded round initially in the top line 11*a* then in the bottom line 11*b*, so that a tube is produced. The shorter strip 4 is preglued so that the strip 14 is stuck locally to the strip 10 after folding in the two lines 11*a*, 11*b*. This valve tube is positioned in the end according to FIG. 4 so that the strips 10 with 14 in the shape illustrated form the valve bottom and the region 13 with the thumb cutout 13*a* form the valve top. As FIG. 4 further shows, the valve tube is inserted into the end and stuck before the strips 16*b* and 16*a* are folded and likewise stuck. The valve projects initially by its corners 17 and 18 beond the sides of the end triangle. However, after the valve sack is filled, the valve is preferably folded in or folded along the pre-creased line 12 and additionally closed with the stuck strip 19*a* of the end cover sheet 19 (FIG. 5) and sealed.

The valve sack according to FIGS. 4–6 apart from the tube blank 15, which in this case, in contradistinction to the sewn valve sack according to FIGS. 1–3, exhibits no lateral folds, is produced from the valve sheet according to FIG. 6 and the end cover sheet 19.

This valve sack, which is provided with a cross end at its two extremities, is more suitable for packaging sensitive materials than the sewn valve sack according to FIGS. 1–3, since it has better powder tightness. The cross bottom sack, however, has inwardly folded corner parts, known as "negative corners". These corners cannot be provided with glue and adequately sealed. Thus, open channels remain in the region of the cross bottom and leakage can occur; complete powder tightness can be achieved only with a further cover sheet according to FIG. 5. In comparison to a sewn valve sack, this valve sack according to FIGS. 4–6 is however considerably more expensive to produce than the sewn valve sack due to the complicated shape of the cross end.

SUMMARY OF THE INVENTION

It is therefore the underlying aim of the invention to produce a valve sack which is highly economical to produce on the one hand, but which on the other hand possesses the advantages of the cross end valve sack as well, and can provide powder-tightness without an additional cover sheet.

Starting from a paper sack with a valve of the category initially mentioned, the invention therefore consists in that, preferably near one of the two wrapped ends, a tubular valve wrapped from paper and self-stuck, through which the closed paper sack can be filled, e.g. through a filling spout of a filling machine, with the pulverous or granular material to be packaged, is let into the longitudinal seam of an open web of paper folded into a tube.

The object of the invention is obtained by providing a paper valve sack which is one or more layers of paper folded round into a flat-lying tube provided with two lateral folds and longitudinally glued. The two open extremities of the respective tube blank are folded round singly or doubly and stuck and thus closed. A valve is let into the longitudinal tube seam transversely to the longitudinal glued seam, in the region of one of the two wrapped ends. The valve is in turn produced from a paper blank folded round into a tube blank and self-stuck. In order to increase the strength of this paper valve sack, a cover sheet is stuck on in the region of the valve.

BRIEF DESCRIPTION OF THE DRAWINGS

The invention and advantageous particulars will be described more fully below in exemplary embodiments with reference to the drawings, wherein:

FIGS. 1–6 show known constructions, already described, of paper sacks with valves;

FIGS. 8–11 show individual steps in the production of the valve sack according to FIG. 7;

FIG. 12 shows the valve region of a valve sack according to the invention in the state of filling with a let-in filling spout;

FIG. 13 shows the filled valve sack with self-closed valve, which has closed itself by the pressure of the contents acting from inside;

DETAILED DESCRIPTION OF THE INVENTION

Figure 6:
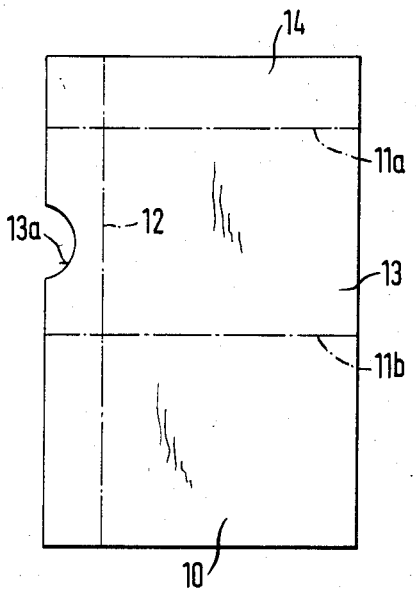
Figure 4:
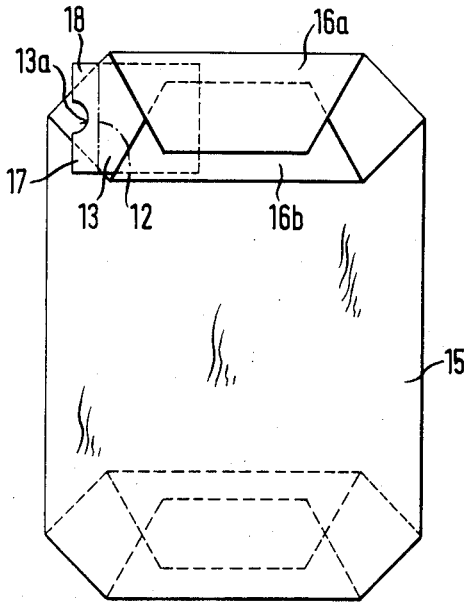
Figure 5:
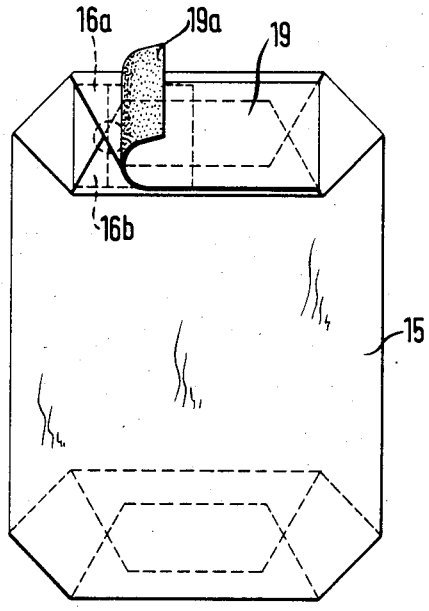
Figure 7:
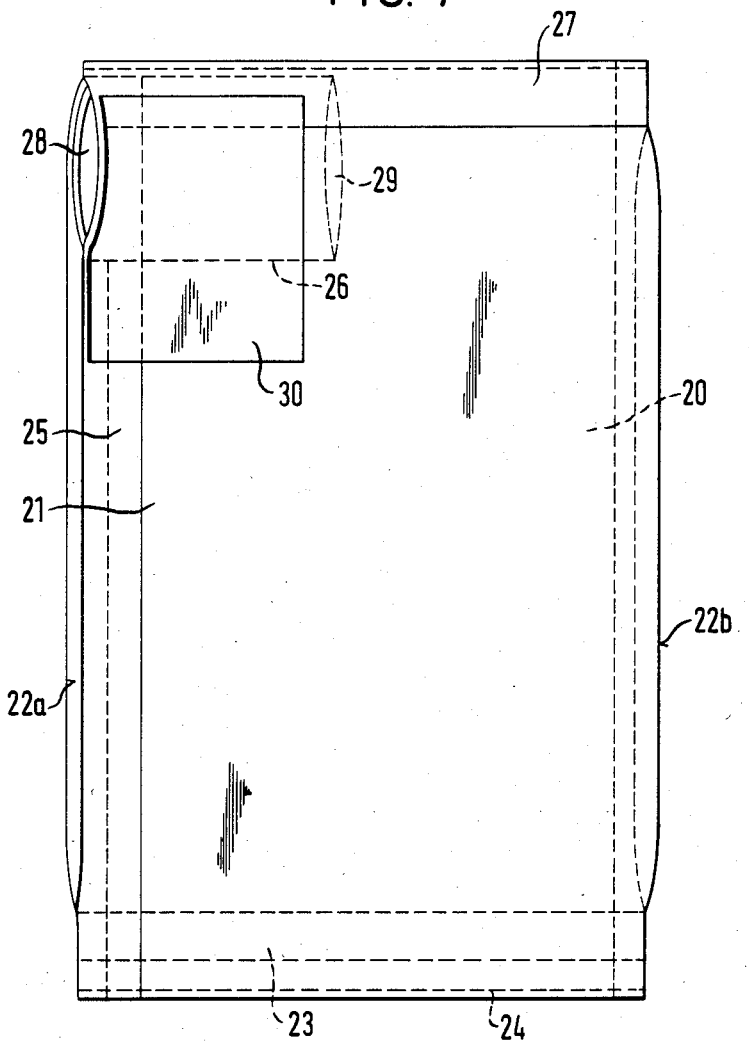
FIG. 7 shows the front elevation of a paper valve sack with features according to the present invention.
Figure 8:
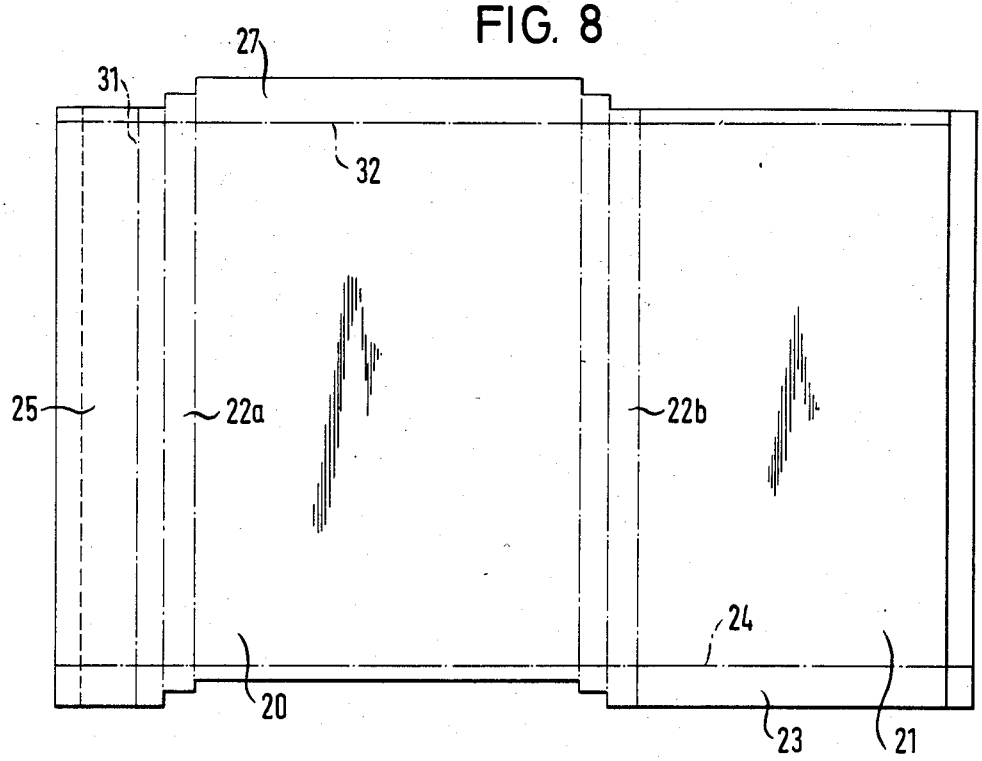
Figure 9:
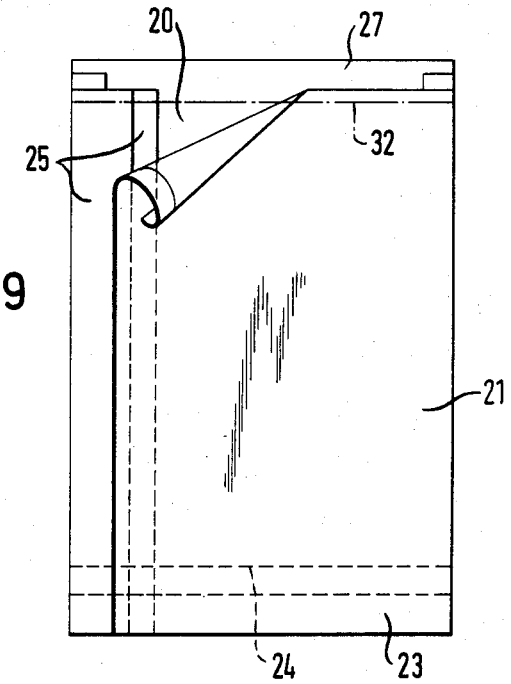

To show the construction of the sack of FIG. 7, FIG. 8 shows the tube blank according to FIG. 9 in unfolded condition. FIG. 9 shows a view of the tube blank with the longitudinal glued seam on the front side. FIG. 8 shows the three longitudinal fold lines, in each case in the region of the two subsequent narrow sides 22*a* and 22*b* of the box-shaped filled valve sack, which form the lateral folds in the flat-lying valve sack or sack blank. The narrow strip 25 is stuck at the longitudinal seam to the wider front strip 21, whereas the rear side 20 of the tube blank and of the subsequent valve sack remains smooth. The tube extremities are cut in step-shaped configuration. In order to close the two extremities of the tube, the strip 27 is folded forwards in FIG. 9 and the strip 23 backwards, and glued.

FIG. 9 also shows a partly opened longitudinal seam. The prefolded valve sheet is introduced into the latter in order to close the top blank line before the strip 27 is folded round. FIG. 10 shows the prefolded valve sheet 26, which is introduced into the open longitudinal seam, so that it is likewise folded round during the subsequent folding of the top closure flap 27 along the pre-creased line 32. Lastly, FIG. 11 shows the valve introduced and stuck in with the front valve orifice 28 and with the valve inlet orifice 29 inside the sack. The valve is introduced in front of the left lateral fold with the crease line 31, and finally the cover sheet 30 is stuck on in order to stiffen the valve region. The finished valve sack is illustrated in front elevation in FIG. 7.

Figure 14:
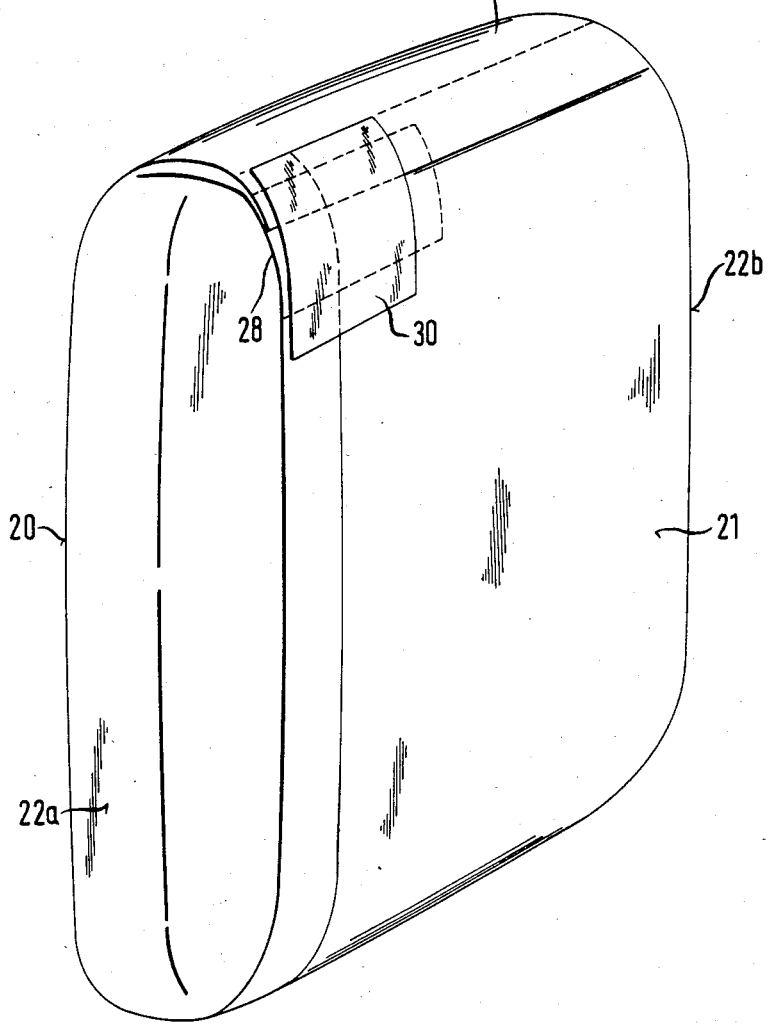
FIG. 14 shows the filled valve sack in a general view.

FIG. 12 illustrates the above-mentioned individual components in the region of the valve during filling, and FIG. 13 after the self-closure of the valve. Whereas the two FIGS. 12 and 13 show sections of the sack in detail, FIG. 14 illustrates the filled valve sack in a general view.

FIG. 8 and FIG. 9 show that in order to close the two ends of the tube blank through simple folding and gluing in each case, it is necessary for the tube blank to be cut in step-shaped configuration at both ends. So that no wastage of material results from the cutting of the tube blank, it necessarily follows that in one case the rear strip 27 according to FIG. 9 must project with reference to the front blank edge, and in the other case the front strip 23 must project with reference to the rear blank edge. It thus results in FIG. 9 that the strip 27 must be folded forwards in the pre-creased line 32, whereas the strip 23 must be folded backwards in order to close the lower bag blank.

FIG. 7 shows a valve sack according to the invention, in which the end closing strip to be folded round does not carry the longitudinal seam, and consequently the end strip must be folded round towards the valve.

The single or double folding over and gluing of both of the open ends of the valve section at first results in a wrap closure (sealing). The rectangular bottom of the valve sack is only formed during the filling process, and has the rectangular dimensions of the width of the flat tube and twice the depth of the side-fold.

According to the invention, the above-mentioned filling valve is preferably positioned within the longitudinal seam such that the valve is located, later-on when the sack is filled, in the transition area between the front part and the bottom part of the sack. Therefore, if the sack is filled, the valve is no longer flat but arched as may be seen from FIGS. 13 and 14. From a geometrical point of view, this means that for the production of a valve sack according to the invention, the center of the flat valve tube has to be fixed in the longitudinal seam at a distance of the depth of one side fold from the inner ply line of the wrap bottom, i.e. the ply line facing the sack.

Figure 15:
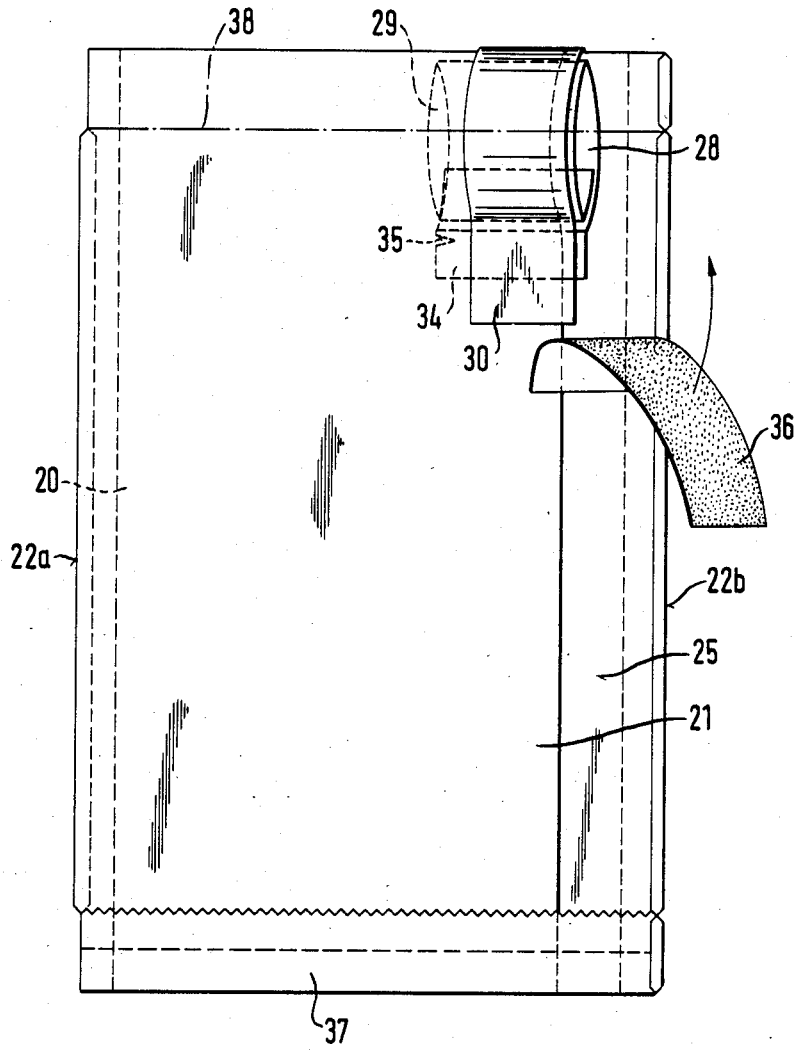
FIG. 15 shows a valve sack according to the invention with a valve let into the longitudinal seam.

On the other hand, FIG. 15 shows a valve sack according to the above invention with a valve let into the longitudinal seam, in which the projecting strip is provided on the longitudinal seam side in the tube blank.

In this case, the end strip must be folded away from the valve. FIG. 18 shows a valve sack according to FIG. 15, but with a different valve. FIGS. 16 and 17, 19 and 20 each show details of the valve sacks illustrated in FIGS. 15 and 18.

Figure 17:
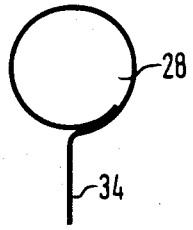
Figure 18:
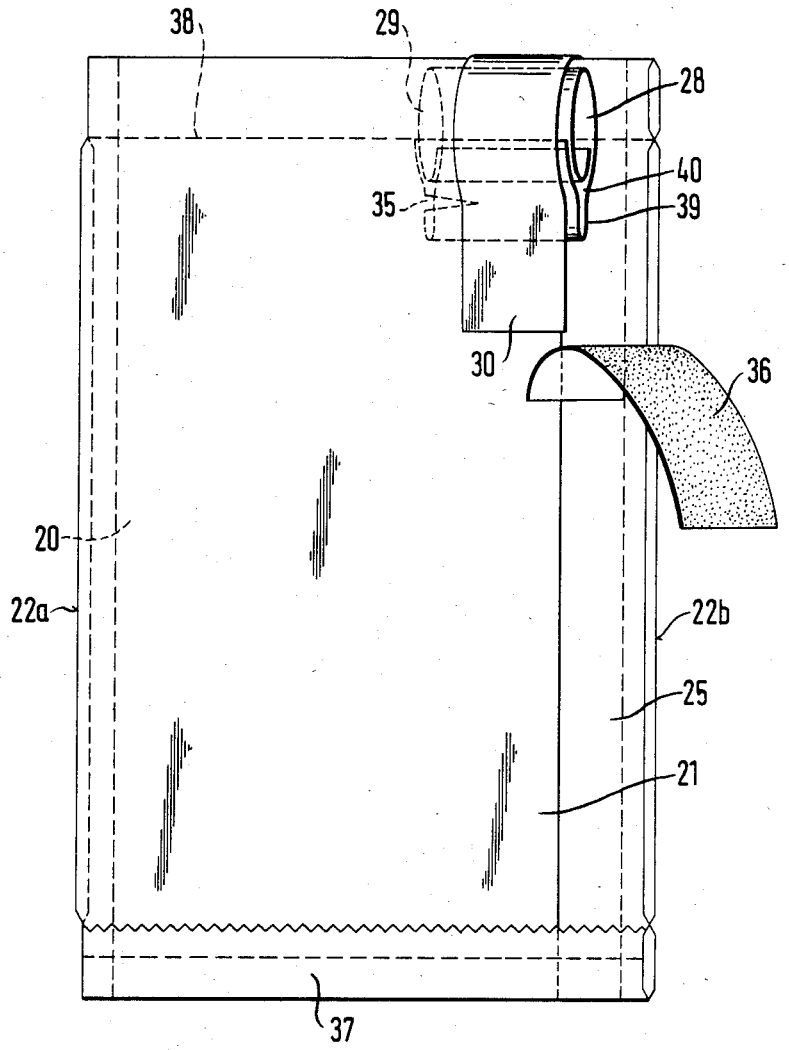
FIG. 18 shows a similar valve sack to FIG. 15, but with a different valve.

The valve sack according to FIG. 15 has a valve which, according to FIG. 17, has the shape of "9" in the open state. In contrast, the valve of the valve sack according to FIG. 18 has, in the open state, the shape of a "Q" as may be seen from FIG. 20.

Figure 16:
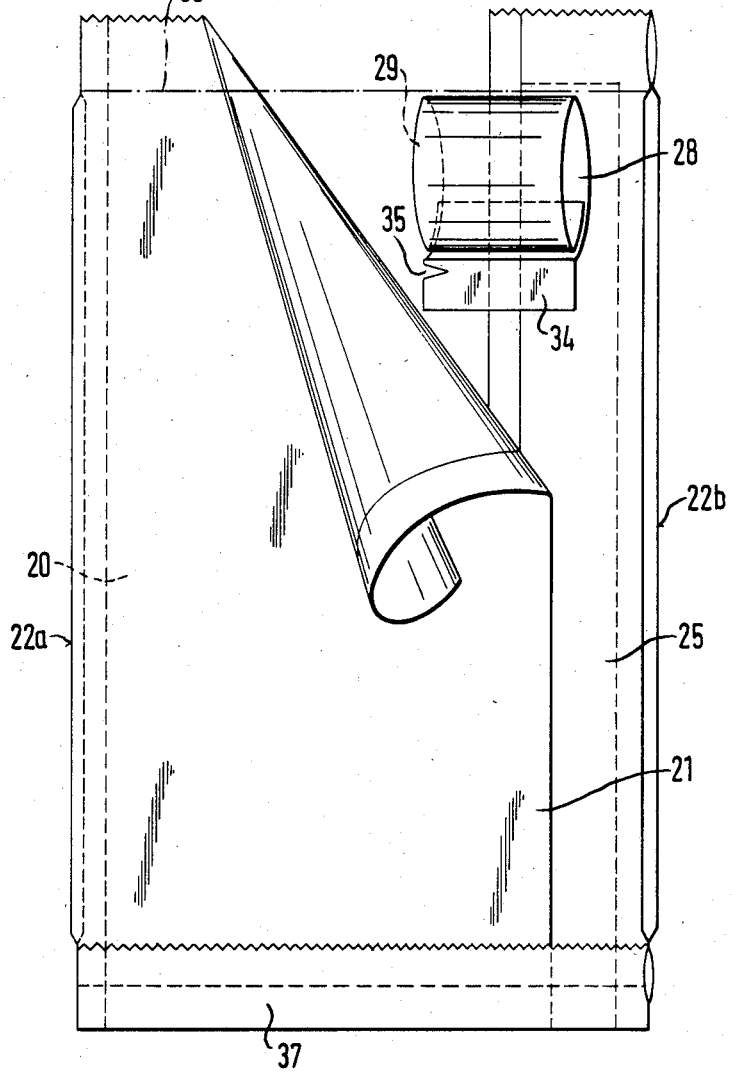
FIGS. 16 and 17 show details of the valve sack according to FIG. 15.

The figures show the following elements. The front side shows at 25 the narrow and at 21 the wide front side strips, which are stuck together along the longitudinal glued seam, not specifically designated. The smooth side of the valve sack is designated 20. The folded-in sides are designated 22*a* and 22*b* respectively, and 37 and 38 are respectively the lower and upper projecting strips, which must be folded round and glued in each case in order to close the respective blank ends. The strip 38 must be folded backwards and the strip 37 forwards. The "9"-shaped valve in FIGS. 15–17 show at 28 the outer inlet orifice and at 29 the inner filling orifice. The righthand side of the valve is stuck against the strip 25, and the lefthand side against the strip 21 according to FIG. 17.

The valve sack is reinforced in the valve region by the projecting strip 34 and the incision 35 ensures that the inner valve nozzle remains freely mobile, which improves the closing characteristics of the valve. In order to reinforce the entire valve region, a reinforcing sheet 30 is stuck onto the finished valve sack as shown in FIG. 15 and the self-adhesive band 36 closes and protects the valve before and after the filling of the valve sack.

Figure 19:
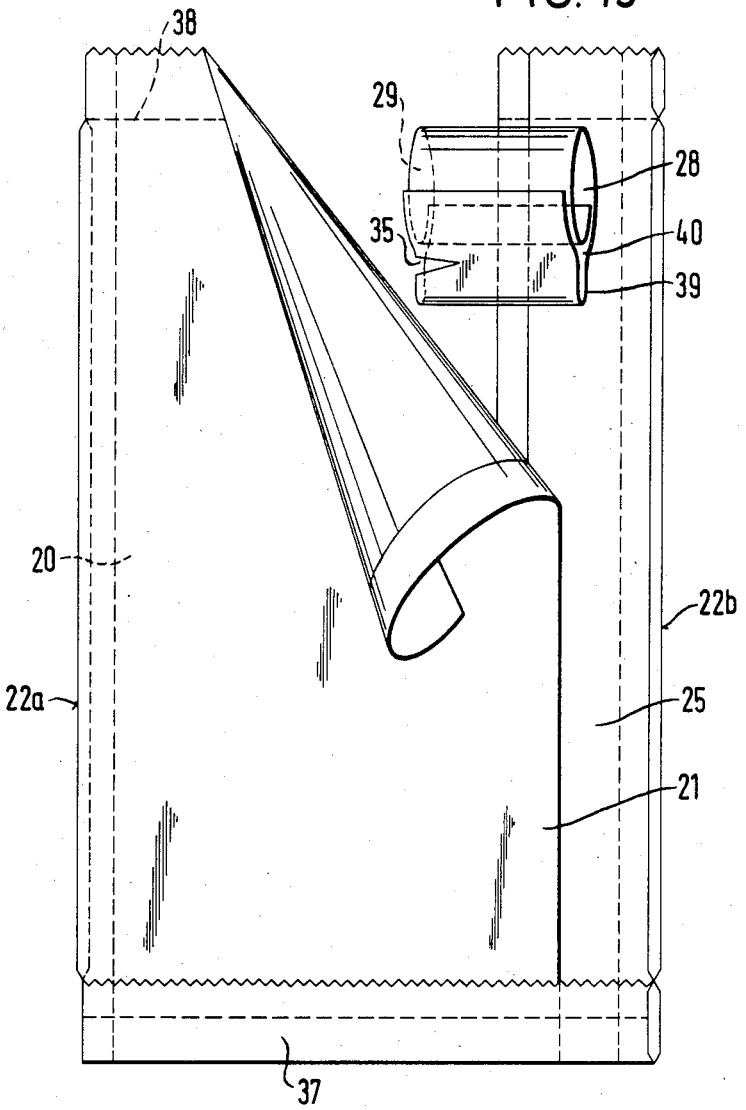
FIGS. 19 and 20 show details of the valve sack according to FIG. 18.
Figure 20:
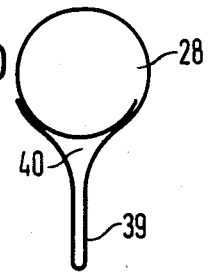

The valve sack according to FIGS. 18–20, in comparison with the valve sack according to FIGS. 15–17, exhibits only modifications in the valve. In this case it is of "Q"-shaped construction. The positively resulting double strip 39 must be self-stuck, as shown in FIG. 20. Similar to the strip 34 according to FIGS. 15–17, strip 39 gives the valve sack greater strength in the region of the valve. The outer filling orifice of the valve is designated 28 and the inner one 29. The righthand side of the valve is stuck to the strip 25 and the lefthand side of the valve to the strip 21 of the paper tube blank, according to FIG. 20. The inner incision 35 again ensures greater freedom of movement and of shape in the inner valve nozzle, which improves the closing characteristics. A special feature of this valve is the pipe 40, which is likewise spread in the open state of the valve according to FIG. 20, out of which surplus air can escape through the orifice 28 during the filling operation of the valve sack.

In the filled sack, the contents press the valve flat, so that both the valve pipe formed by the inlet orifice 28 and inner outlet orifice 29, and also the pipe 40 are closed. In order to reinforce the valve sack in the valve region, a cover sheet 30 is again stuck on, and the cover sheet 36, preferably constructed as an adhesive band, serves for the protection and the absolutely powder-tight closure of the valve before and after the filling operation. Band 36 may be removed prior to filling and re-applied afterwards.

Further advantageous shapes of valves are illustrated in FIGS. 21–23, 24–26 and 27–29.

Figure 21:
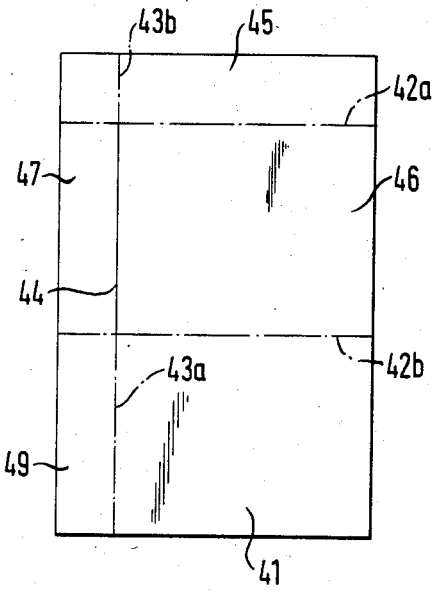
FIG. 21 shows an open sheet of paper, from which a valve is shaped for a valve sack according to the invention.

FIG. 21 shows the open sheet of paper, from which the valve is shaped. The two lines 42*a*, 42*b* show two transverse precreased lines and the line 43*a*, which extends from the bottom edge of the paper to the lower pre-creased line 42*b*, shows a vertical pre-creased line. Continuing from the lower pre-creased line 43*a*, the line 44 represents an incision. In order to form the valve, the strip 45 is folded forwards along the pre-creased line 42*a*, and in step 2 the strip 46 is folded round with the front strip 47 and with the already folded strip 45 in the lower pre-creased line 42*b*, so that the strip 45 comes to lie upon the lower edge of the strip 49. In this way the surface 46 according to FIG. 21 forms the valve underside according to FIG. 22, the surface 46 according to FIG. 21 forms the valve upperside according to FIG. 22, whereas the strip 45 according to FIG. 21 forms an intermediate layer in FIG. 22.

Figure 22:
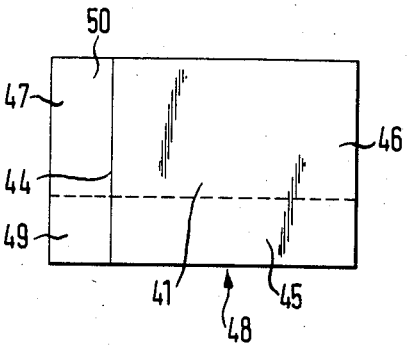
FIGS. 22–29 show further advantageous embodiments of valves.
Figure 23:
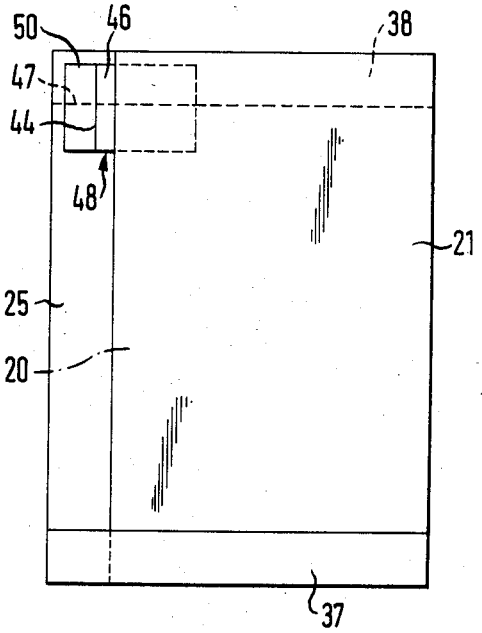

FIG. 23 illustrates how this valve is introduced into a valve sack according to FIGS. 15 and 18. The edge 48 of FIG. 22 forms the valve lower edge in FIG. 23. The surface 46 forms the valve web stuck to the inside of the wide top strip 20 of the bag blank, whereas the surface 41 of FIG. 21 is stuck to the narrow strip 25 according to FIG. 23. The region 49 of FIGS. 21 and 22, which lies in the plane of the valve underside, is not stuck to the strip 25 of the tube blank.

The filling of the valve sack illustrated in FIG. 23 is effected through the incision 44. After the filling of the valve sack, the valve can be folded round with the strip 47 and 50 along the pre-creased line 43*a* and along the cut line 44 and stuck to the long strip of the longitudinal seam side of the bag blank 21. In FIG. 23, 38 shows the top end strip folded round backwards and 37 the bottom end strip folded round forwards. The rear side of the bag is designated 20.

Figure 24:
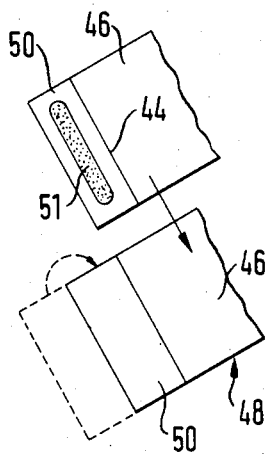
Figure 25:
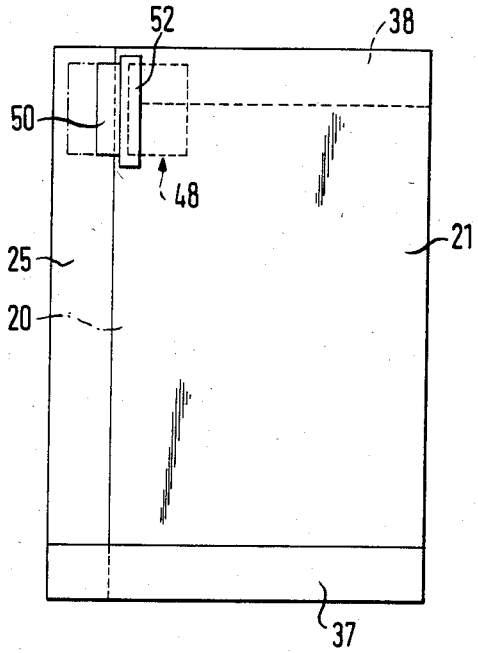

An advantageous supplementation of the valve according to FIGS. 21 and 22 is illustrated in FIG. 24. The foldable part of the valve can be advantageously stuck to the large strip of the longitudinal seam side of the valve sack by the self-adhesive band 51. An additional adhesive band 52 gives further security.

Figure 26:
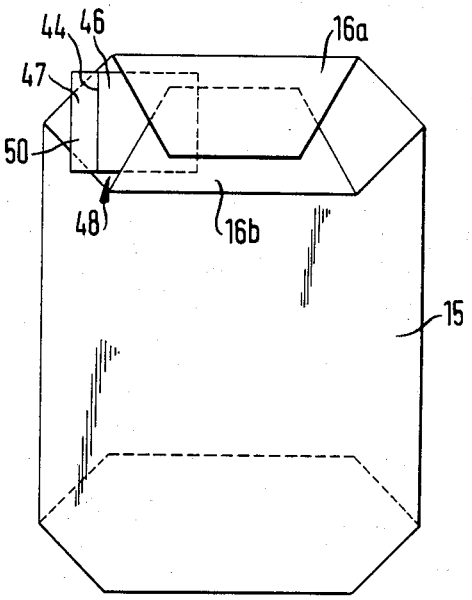

FIG. 26 shows that this valve can also be inserted advantageously in a cross-end bag, in which case the valve, in contradistinction to the previous figures, is inserted not in the longitudinal seam but in the end of the valve sack. The designations apply similarly according to FIGS. 4, 5 and 21–25.

Figure 27:
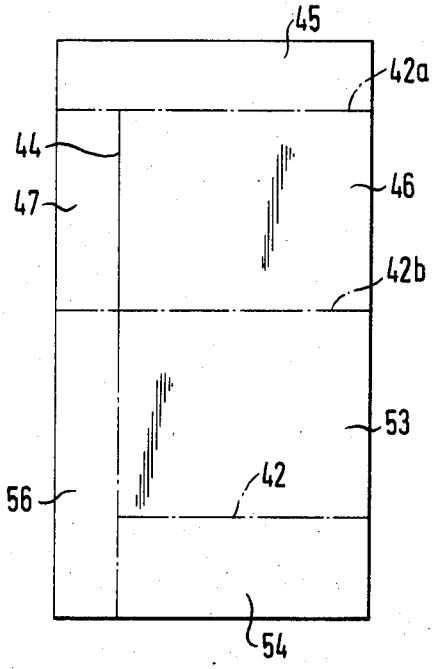
Figure 28:
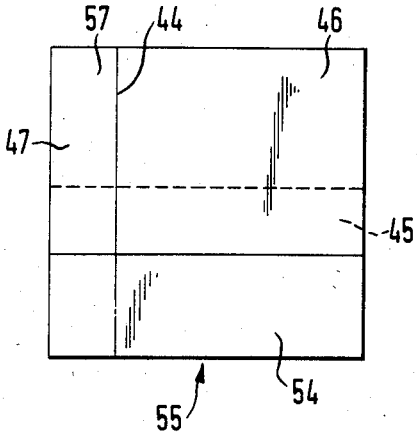
Figure 29:
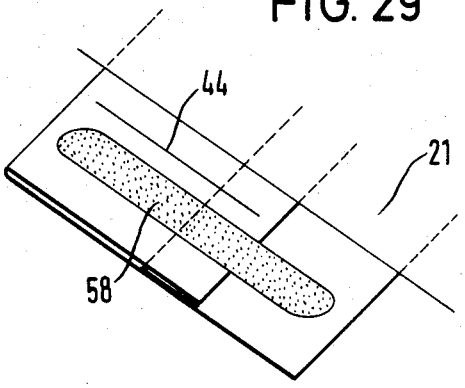

Another advantageous variant of the valve is shown in FIGS. 27–29. In the finally folded and self-stuck state according to FIG. 28, it corresponds to the "9"-shaped valve according to FIG. 17 with the particular supplementations according to FIGS. 21, 22 and 24.

Compared to the valve sheet according to FIG. 21, the valve sheet 28 is lengthened, so that a bottom strip 54 projects beyond the subsequent valve rear side 53, and is stuck in the longitudinal seam of the valve sack on both sides according to strip 34 as shown in FIGS. 15–17, and thus gives the valve sack greater strength in the valve region. Now, similarly, the lower edge 55 of the strip 54 forms the lower edge of the valve in the valve sack according to FIG. 23.

The region 56 of the open valve sheet according to FIG. 27, line the region 49 according to FIG. 21, is not to be stuck to the shorter strip of the tube blank 25 according to FIG. 23. The regions 47, 56 and a part of the region 45 are folded round as region 57 according to FIG. 28 along the line 44 for the subsequent closure of the valve, whilst the manipulation is advantageously facilitated by a self-adhesive coating 58.

What is claimed is:

1. A paper valve sack, comprising:

a flattened paper tube having a longitudinal axis;

a first end of said flattened tube being folded closed along a first line, said first line being substantially transverse to said longitudinal axis;

a second end of said flattened tube being folded closed along a second line, said second line being substantially transverse to said longitudinal axis;

said flattened tube defining first and second sides, said first side comprising a first strip and a second strip, said first strip being folded over said second strip to form a longitudinal seam which extends at least from said first line to said second line;

a collapsible filling valve in said longitudinal seam between said first and second strips, said collapsible filling valve comprising an outer filling orifice and a projecting strip, said outer filling orifice and said projecting strip being oriented transverse to said longitudinal axis, and means including said projecting strip being secured at its respective sides to the first and second strips and between said first and second lines, whereby said projecting strip distributes forces arising in the vicinity of said filling valve during filling of said paper valve sack, thereby reducing tensile stresses and the tendency to rupture resultant therefrom.

2. A valve sack as claimed in claim 1, wherein said projecting strip is a double strip defining an inner orifice, said inner orifice having an interior and an exterior, the interior of said inner orifice allowing air to escape during filling.

3. A valve sack as claimed in claim 1, wherein said projecting strip has an incision therein, said incision ensuring that the collapsible filling valve remains freely mobile during filling of said valve sack.

4. A valve sack as claimed in claim 1, wherein a reinforcing sheet is secured to at least one of said first and second strips in the region of said collapsible filling valve to reinforce said valve sack in said region.

5. A valve sack as claimed in claim 1, wherein a cover sheet is applied over said collapsible valve, said cover sheet ensuring powder-tight closure.

* * * * *